US012208434B2

(12) United States Patent
Martin

(10) Patent No.: US 12,208,434 B2
(45) Date of Patent: Jan. 28, 2025

(54) BENDING APPARATUS FOR COILED TUBING

(71) Applicant: Kristian Martin, Prince Rupert (CA)

(72) Inventor: Kristian Martin, Prince Rupert (CA)

( * ) Notice: Subject to any disclaimer, the term of this patent is extended or adjusted under 35 U.S.C. 154(b) by 0 days.

(21) Appl. No.: 18/194,492

(22) Filed: Mar. 31, 2023

(65) Prior Publication Data

US 2023/0241663 A1 Aug. 3, 2023

Related U.S. Application Data

(63) Continuation-in-part of application No. 17/026,195, filed on Sep. 19, 2020, now Pat. No. 11,623,263.

(51) Int. Cl.
*E21B 19/22* (2006.01)
*B21D 26/041* (2011.01)

(52) U.S. Cl.
CPC ..... *B21D 26/041* (2013.01); *E21B 19/22* (2013.01)

(58) Field of Classification Search
CPC ..... E21B 19/22
See application file for complete search history.

(56) References Cited

U.S. PATENT DOCUMENTS

| | | | |
|---|---|---|---|
| 205,069 | A | 6/1878 | Farnsworth |
| 805,579 | A | 11/1905 | Patchen |
| 1,500,921 | A | 7/1924 | Bramson et al. |
| 1,752,193 | A | 6/1928 | O'Hanlon |
| 2,545,701 | A | 3/1951 | McCausland |
| 3,458,219 | A | 7/1969 | Wesch |
| 3,479,067 | A | 11/1969 | Potts |
| 4,091,867 | A | 5/1978 | Shannon, Jr. et al. |
| 4,317,586 | A | 3/1982 | Campbell |
| 4,475,750 | A | 10/1984 | Campbell |
| 4,848,455 | A | 7/1989 | Fenyvesi |
| 4,899,823 | A | 2/1990 | Cobb et al. |
| 5,454,419 | A | 10/1995 | Vloedman |
| 5,803,168 | A | 9/1998 | Lormand et al. |
| 6,006,839 | A | 12/1999 | Dearing et al. |
| 6,209,634 | B1 | 4/2001 | Avakov et al. |
| 6,279,373 | B1 | 8/2001 | Averbuch et al. |
| 6,554,072 | B1 | 4/2003 | Mournian et al. |

(Continued)

FOREIGN PATENT DOCUMENTS

| | | |
|---|---|---|
| GB | 2581959 | 9/2020 |
| WO | 2011096820 | 8/2011 |

*Primary Examiner* — Giovanna Wright
(74) *Attorney, Agent, or Firm* — Craft Chu PLLC; Andrew W. Chu

(57) ABSTRACT

A bending apparatus for coiled tubing protects along the entire path of coiled tubing from the reel to the injector, while still protecting a main controlled bend to the injector. The bending apparatus includes a conduit having a bend portion and a flexible portion. The main controlled bend is isolated in the bend portion, while smaller adjustment bends can be designated for the flexible portion. An impingement sleeve further protects and support coiled tubing within the conduit. The bend portion can be defined by an exterior support for the stability and strength of the bend portion, when the entire conduit is made of flexible material. A threader provides for safe loading from the reel to the conduit. A buckle preventer can be added to prevent damage after exiting the conduit. A blowout preventer can be added to cut and isolate the coiled tubing between the conduit and the reel.

19 Claims, 10 Drawing Sheets

(56) References Cited

U.S. PATENT DOCUMENTS

| | | | | |
|---|---|---|---|---|
| 7,165,619 | B2 | 1/2007 | Fox et al. | |
| 7,810,556 | B2 | 10/2010 | Havinga | |
| 9,228,395 | B2 | 1/2016 | Armstrong et al. | |
| 10,787,866 | B2 | 9/2020 | Thomas et al. | |
| 11,623,263 | B2 * | 4/2023 | Martin ..... | B21D 26/041 72/62 |
| 2004/0036293 | A1 | 2/2004 | Flindall | |
| 2019/0285211 | A1 | 9/2019 | Von Keitz | |

* cited by examiner

BENDING APPARATUS FOR COILED TUBING

CROSS-REFERENCE TO RELATED APPLICATIONS

The present application claims priority under 35 U.S.C. Section 120 from U.S. patent application Ser. No. 17/026,195, filed on 19 Sep. 2020, entitled "BENDING APPARATUS FOR COILED TUBING".

See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to oil and gas machinery and devices. In particular, the present invention relates to a coiled tubing equipment. More particularly, the present invention relates to an adjustable bending apparatus with cooperative impingement sleeves for inserting coiled tubing into a wellhead.

2. Description of Related Art Including Information Disclosed Under 37 CFR 1.97 and 37 CFR 1.98

Coiled tubing is regular component in well interventions, well drilling, and well completions, that is, well servicing operations, like injecting different fluids into a well. Coiled tubing is long and continuous metal pipe that is stored on large reels and dispensed by turning the reel. The coiled tubing is inserted into a well through a wellhead, usually under pressure. Coiled tubing is important because liquids can be pumped into the coiled tubing without reliance on gravity. No pipe connections are required to deploy the coiled tubing into a well under pressure.

An important issue with coiled tubing is that the metal pipe must be bent several times. The first bending event occurs as the coiled tubing is initially straightened as dispensed from the reel. The coiled tubing is bent the second time as the coiled tubing passes onto the gooseneck or guide arch. Then, the third time when the coiled tubing is bent from the gooseneck to the injector. The coiled tubing is bent the fourth time when the coiled tubing is pulled out of the well and bent back onto the gooseneck. The fifth bend ensues when the coiled tubing is straightened off the gooseneck to be spooled back onto the reel. The straightened coiled tubing bends for the sixth time when winding back onto the reel. Four of the six bends occurs at the gooseneck, with another two bends at the reel.

Prior art patent documents related to bending coiled tubing include U.S. Pat. Nos. 5,279,364, 6,695,048, and USPub20040211555. U.S. Pat. Nos. 6,695,048, 5,454,419, 4,899,823 and US Publication No. 20040211555 also disclose goose neck and other arched guide structures. U.S. Pat. Nos. 6,209,634, 7,165,619, 5,803,168, and 7,810,556 disclose various guide members to protect the coiled tubing from damage during the bending. Kinks and severe angles damage coiled tubing. A notch or other structural defect affects the strength, durability and functionality. A damaged coiled tube cannot protect the pressurized contents within the coiled tubing. A tear or gash will weaken the integrity coiled tubing so that fluids and gases in pressure and temperature conditions cannot be safely maintained. When coiled tubing is bent, the amount of bending is controlled so that there is less risk of damage to the coiled tubing. The prior art guides and arcs form a smooth curve for bending the coiled tubing at a safe curvature. Additionally, guide members of the prior art further protect the coiled tubing for the force exerted to bend. There is no quick large force to sharply bend the coiled tubing into position. The amount of bending and the force exerted to bend are controlled.

As metal pipe, there is a limited amount of bending before the structural integrity of the coiled tubing is lost. With some coiled tubing, within internal tubing pressures of 5000 psi, some computer models estimate 20 cycles (sets of 6 bends) before degradation of the coiled tubing, so coiled tubing is not very re-useable. These 20 cycles apply to the interior of the coiled tubing being pressurized relative to the exterior of the coiled tubing, i.e. the coiled tubing being dispensed in the open air. Some computer models also estimate 130 cycles (sets of 6 bends), if there is no pressure differential between the interior of the coiled tubing and the exterior of the coiled tubing. The pressure differential while bending affects the working life of the coiled tubing.

Pressurized bending is another protection for coiled tubing. U.S. Pat. Nos. 4,091,867 and 6,006,839 disclose pressure equalization during the bending process. The pressure inside the coiled tubing and outside the coiled tubing are equalized to extend the working life of the coiled tubing. Reducing the pressure differential between the inside and outside of the coiled tubing further reduces risk of damaging the coiled tubing during a bending process.

Protections of coiled tubing are limited to the coiled tubing within the bending apparatus. There are gaps in protection coiled tubing between the storage of coiled tubing on a reel or spool and the pressure neck device for bending the coiled tubing and between the pressure neck device for bending and the injector into a wellhead. Although conditions for bending are controlled within the prior art pressure neck devices, there are no protections of coiled tubing until the coiled tubing is inserted into the prior art pressure neck devices. The reel or spool dispenses the coiled tubing so that the coiled tubing may be damaged by sharp bends or kinks, while traveling to and being aligned into the prior art pressure neck devices.

FIG. 1 is a schematic side elevation view of a prior art system 1 of a pressure neck 2 at a wellhead 6. FIG. 1 shows that the upright angle of dispensing from the reel 3 changes as more of the coiled tubing 4 is dispensed to the injector 5. The upright angle of dispensing is constantly changing as the path to the pressure neck device changes. There is a high risk of kink and sharp bend damage 7 to the coiled tubing at the inlet to the pressure neck device as the upright angle changes from the reel 3 at full capacity, middle capacity, and low capacity. Only one level of capacity can be aligned with the prior art pressure neck 2 to reduce the risk of damage.

FIG. 2 is a schematic view of the prior art system 1 of the pressure neck 2 in a top plan view. FIG. 2 shows that the lateral angle of dispensing from the reel 3 changes as more of the coiled tubing 4 is dispensed to the injector 5. FIG. 2 shows that the lateral angle of dispensing from the reel 3 also changes as more coiled tubing in dispensed. The lateral angle of dispensing constantly changes and oscillates back and forth between ends of the reel 3 or spool. There is even more risk of kink and sharp bend damage 8 to the coiled tubing at the inlet to the pressure neck device.

With the rigidity of the prior art pressure neck 2, the kink and sharp bend damage 9 can also occur at a junction between the pressure neck 2 and injector 5 as shown in FIG. 3. The coiled tubing may yank and pull at the outlet of the pressure neck 2, as in FIG. 3, or at the inlet, as in FIGS. 1 and 2.

There is a need for safer bending of the coiled tubing while in the pressure neck device. Any support of a flexible portion may be too rigid and reduces the adjustability of the flexible portion. Additionally, an impingement sleeve, that gradually bends the coiled tubing within the conduit, can have more consistency and control. The impingement sleeve can be adjustable and replaceable, when the wear on the impingement sleeve is uneven.

There is another need to support the conduit of the pressure neck, when the conduit has unitary construction. The bend portion and flexible portion must be supported differently, when the conduit is constructed of a single material.

There is also a need for safer loading of the coiled tubing through a pressure neck device. The initial threading of the coiled tubing from the reel and into the pressure neck device can risk damage to the coiled tubing and components inside the pressure neck. The risk may be less than loading the coiled tubing directly into the injector, but even small bends and abrasions can reduce the working life of the coiled tubing.

It is an object of the present invention to provide a bending apparatus to protect the coiled tubing within the conduit of the bending apparatus.

It is another object of the present invention to provide a bending apparatus to maintain the bend angle of the conduit of the bending apparatus for the coiled tubing with an impingement sleeve.

It is still another object of the present invention to provide a bending apparatus having an impingement sleeve that can replace worn areas of the impingement sleeve without having to replace the entire sleeve.

It is still another object of the present invention to provide a bending apparatus that can cut the coiled tubing in an emergency, while retaining the coiled tubing within the conduit.

It is yet another object of the present invention to provide a bending apparatus that can reduce buckling risk when the coiled tubing exits the conduit.

It is an object of the present invention to provide a bending apparatus to maintain the bend angle of a conduit of unitary construction.

It is another object of the present invention to provide a bending apparatus to maintain the bend angle of the conduit of unitary construction with an exterior support system.

It is an object of the present invention to provide a bending apparatus for inserting coiled tubing from a reel or spool and into a well through a wellhead.

It is an object of the present invention to provide an apparatus to protect the coiled tubing when initially loading from the reel and through the bending apparatus.

It is an object of the present invention to provide an apparatus to reduce bending stress on the coiled tubing between the reel and the apparatus of the present invention.

It is an object of the present invention to provide a safe and reliable apparatus and method to dispense coiled tubing for bending into a wellhead.

These and other objectives and advantages of the present invention will become apparent from a reading of the attached specification.

BRIEF SUMMARY OF THE INVENTION

Embodiments of the present invention include a bending apparatus for coiled tubing to be inserted into a wellhead by an injector from a reel. The coiled tubing is stored on the reel and is unraveled to be dispensed to the wellhead or raveled to be gathered from the wellhead. The upright angle of the coiled tubing being dispensed from different levels on the reel changes. The lateral angle of the coiled tubing being dispensed from side to side across the reel also changes. Even though prior art devices protect a controlled bend from the reel to the injector, the changing upright angle and lateral angle of the coiled tubing between the reel and the bending apparatus are not protected from damage to the coiled tubing. The bending apparatus of the present invention finally provides some protection of the entire path of coiled tubing from the reel to the injector, while still protecting that main controlled bend or critical bend inside the pressure neck to the injector.

An embodiment of the bending apparatus includes a conduit with a bend portion and a flexible portion with the bend portion clearly distinguished from the flexible portion. The conduit has a proximal end and a distal end, which determine a conduit bend angle of the conduit. The conduit can be bent, and the conduit bend angle is the amount of bend corresponding to the coiled tubing entering the conduit in one direction and exiting the conduit in another direction. For the changes in upright angle of the coiled tubing from the reel and for some changes in the lateral angle of the coiled tubing from the reel, the conduit is comprised of a bend portion and a flexible portion. The bend portion has an injector end toward the proximal end and a spool end toward the distal end, which determine a bend angle. The flexible portion has a first flexible end toward the proximal end and a second flexible end toward the distal end, which determine a flexible bend angle. The conduit bend angle is comprised of the bend angle and the flexible bend angle. The main controlled bend is isolated in the bend portion, while a smaller adjustment bend is allowed for the flexible portion. The changes in the upright angle from dispensing coiled tubing from different levels of the reel no longer cause damage because the flexible bend angle can adjust to those changes. The changes in the lateral angle from dispensing coiled tubing from different levels of the reel no longer cause damage because the flexible bend angle can also adjust to those changes.

The amount of bend and the amount of force to bend are further controlled by the impingement sleeve to lower the risk of damage to the coiled tubing. The impingement sleeve has a first sleeve portion in the bend portion and a second sleeve portion in the flexible portion. The wear and tear are dissimilar along the entire length of the impingement sleeve. The wear can be dissimilar on the second sleeve portion so the second sleeve portion is detachable from the first sleeve portion for replacement of the second sleeve portion without replacing the entire impingement sleeve. The bend angle and the flexible bend angle are supported and controlled cooperatively.

Embodiments of the bending apparatus of the present invention are also compatible with safety components at both proximal and distal ends of the conduit. The safety components can reduce buckling of the coiled tubing and retain coiled tubing in the bending apparatus and injector, in emergency cut-off situations.

Another embodiment of the present invention includes both the bend portion and the flexible portion of the conduit being comprised of a flexible tubular member. The bend portion is further comprised of an exterior support system to set the bend angle and the bend portion, despite the flexible construction material of the conduit. One type of exterior support system is an exoskeleton, including an inner curved spine and an outer rib system. The outer rib system can be an outer rib or a plurality of outer ribs. The flexible tubular member fits within the outer rib system along the inner curved spine. There can also be an additional support means for the flexible portion cooperative with the exterior support system.

The present invention further includes an embodiment of a bending and loading apparatus with a threader having a lead end and a tubing connector end. The lead end removably engages the conduit and the tubing connector end guides the coiled tubing into the conduit so as to load the coiled tubing into the conduit. The threader comprises a flexible cable; a plurality of gripper beads mounted along the flexible cable; and a tubing connector attached to the flexible cable at the tubing connector end. The threader is a temporary component that is only used to load the coiled tubing. Each gripper bead can be comprised of a bead body; a proximal bead end having a proximal outer tapered surface; and a distal bead end. The bead body is between the proximal bead end and the distal bead end with the distal bead end facing toward the tubing connector end. In some embodiments, the proximal outer tapered surface is conical so that each bead passes through the conduit to maintain alignment along the flexible cable without extraneous contact or scratching of the conduit or impingement sleeves within the conduit.

DETAILED DESCRIPTION OF THE INVENTION

Figure 1:
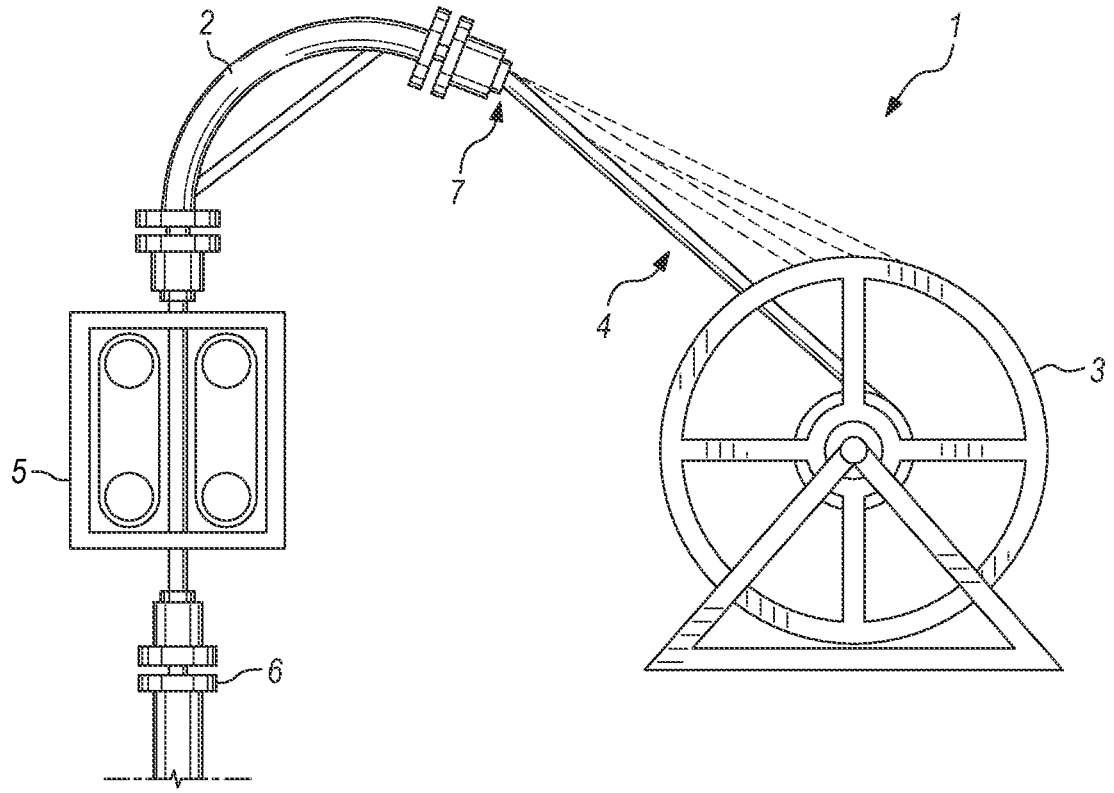
FIG. 1 Prior Art
FIG. 1 is a schematic side elevation view of a prior art system of a pressure neck or guide arc.
Figure 2:
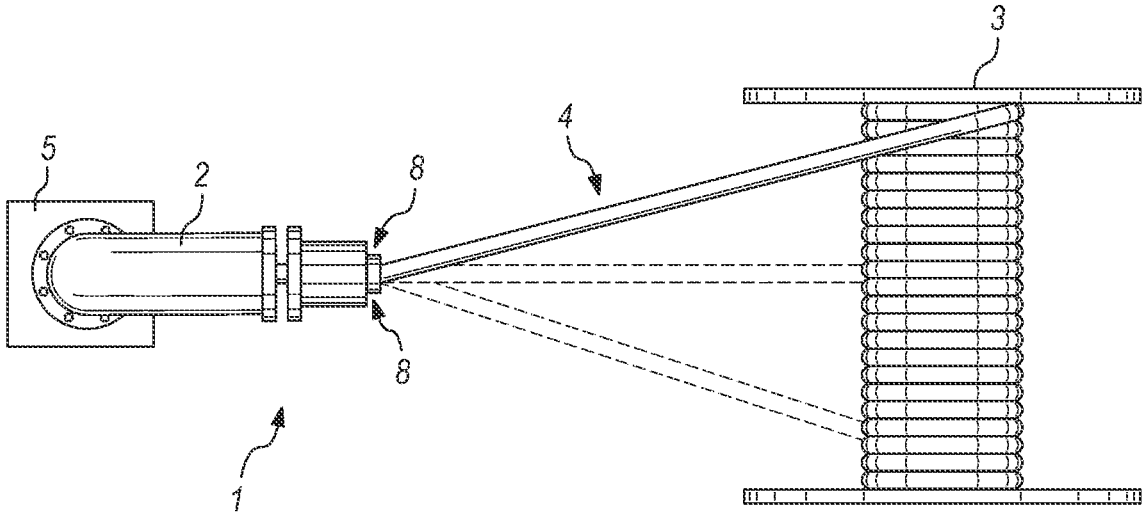
FIG. 2 Prior Art
FIG. 2 is a schematic view of the prior art system of a pressure neck or guide arc in a top plan view.
Figure 3:
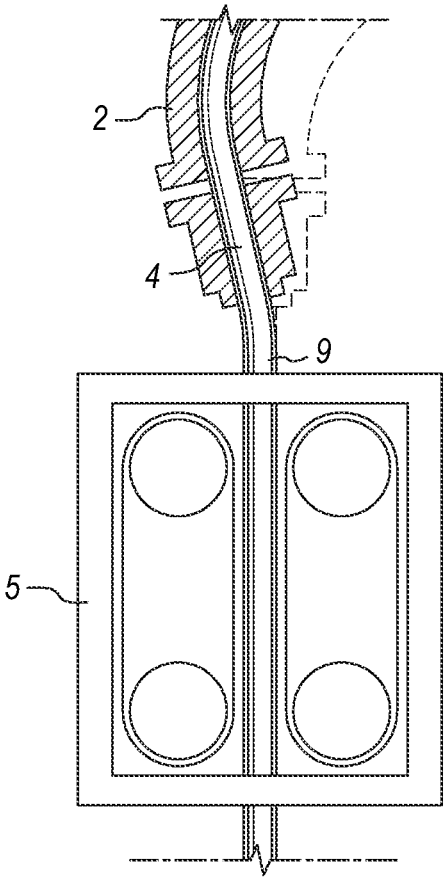
FIG. 3 Prior Art
FIG. 3 is a schematic view of a junction between a prior art pressure neck and injector.

Bending coiled tubing is one step in the process of inserting the coiled tubing into a well through a wellhead. The coiled tubing is already known to be stored on a reel or spool and dispensed from the reel or spool. The coiled tubing is stored in a bent or curved configuration and is unraveled from the reel or spool only to be bent again so as to be aligned with an injector. The injector inserts the coiled tubing through a wellhead, usually under pressure. The protection of the coiled tubing during the step of bending and the devices to perform the bending are known in the prior art. However, there are additional risks for damage separate from the actual bending. In particular, the path from the reel or spool to the pressure neck and the path from the pressure neck to the injector have high risks for damage, that could render the coiled tubing non-functional or negatively affect the working life of the coiled tubing. The bending apparatus of the present invention protects the critical bend angle of the coiled tubing, which is the important bending of the coiled tubing for alignment into the injector. In the present invention, the bend portion is clearly distinguished from the flexible portion so that the bend angle of the bend portion corresponds to the critical bend angle of the coiled tubing. Not all bending in the bending apparatus is treated the same. The bend angle of the bend portion is protected by the flexible bend angle of the flexible portion. The smaller, but more dynamic, adjustments are made by the flexible portion. The flexible portion reduces the impact of these more dynamic adjustments required from the dispensing of the coiled tubing from large reels. The bending apparatus itself is not pulled and yanked as in the prior art. The flexible portion is pulled and yanked so that the flexible bend angle transitions the coiled tubing to the bend angle with more stability and support. There is less risk of damage to the coiled tubing by the transition from the reel to the injector when the flexible portion transitions coiled tubing to the bend angle of the bend portion for the critical bend angle of the coiled tubing.

The present invention also includes an impingement sleeve to further support and protect the coiled tubing within the bending apparatus or pressure neck. There are differences in wear and tear on the different portions of the impingement sleeve corresponding to the bend portion and the flexible portion of the conduit. The different forces on the bend portion and the flexible portion also affect the impingement sleeve. The impingement sleeve can replace some portions due to uneven wear along the conduit of the pressure neck. There are also safety components, such as blow-out preventers and buckle protectors, compatible with the bending apparatus of the present invention for further support and protection of the coiled tubing. The ends of the conduit are also compatible with various attachments for support and protection of the coiled tubing.

In embodiments with unitary construction of both the bend portion and the flexible portion of the conduit, the bend portion must still have a strong and stable bend portion for the critical bend angle of the coiled tubing. An exterior support system can be attached to the conduit to form the bend portion, when fabrication requires the entire conduit to be made of a single material. Another support means can support the flexible portion, when the bend portion has the exterior support system. Again, the present invention supports the bend portion with the bend angle different from the flexible portion with the flexible bend angle exposed to the more frequent, but smaller adjustments.

The bending apparatus is also compatible with a removable threader for initially loading the coiled tubing into the bending apparatus.

The present invention is a bending apparatus 10 for coiled tubing to protect the entire path of coiled tubing 4 from the reel 3 to the injector 5, while still protecting the main controlled bend or critical bend angle of the coiled tubing somewhere within the bending apparatus 10 between the reel 3 and the injector 5. FIGS. 4-9, 12, 14, 16, 17, and 20 show embodiments of the bending apparatus 10 comprising a conduit 20. The conduit 20 has a proximal end 22 and a distal end 24 opposite the proximal end. The proximal end 22 is positioned relative to the distal end 24 so as to determine a conduit bend angle 26 of the conduit. The conduit 20 is bent, and the conduit bend angle 26 is the amount of bend corresponding to the coiled tubing entering the conduit 20 in one direction and exiting the conduit 20 in another direction, corresponding to the conduit bend angle 26. The proximal end 22 does not face opposite the distal end 24 because of the conduit bend angle 26. The face of the proximal end 22 is angled relative to the face of the distal end 24. The conduit bend angle 26 is a controlled and protected bend of the present invention to dispense coiled tubing from a reel or spool to an injector of a well head.

FIGS. 4-9, 12, 14, 16, 17, and 20 show embodiments of the conduit 20 comprised of a bend portion 30 and a flexible portion 60. The bend portion 30 has an injector end 32 toward the proximal end 22 and a spool end 34 toward the distal end 24 and opposite the injector end 32. The injector end 32 is positioned relative to the spool end 34 so as to determine a bend angle 36 of the bend portion 30. FIGS. 4-9, 12, 14, 16, 17, and 20 further show the conduit 20 being comprised of a flexible portion 60 having a first flexible end 62 toward the proximal end 22 and a second flexible end 64 toward the distal end 24 and opposite the first flexible end 62. The first flexible end 62 is positioned relative to the second flexible end 64 so as to determine a flexible bend angle 66 of the flexible portion 60.

Figure 4:
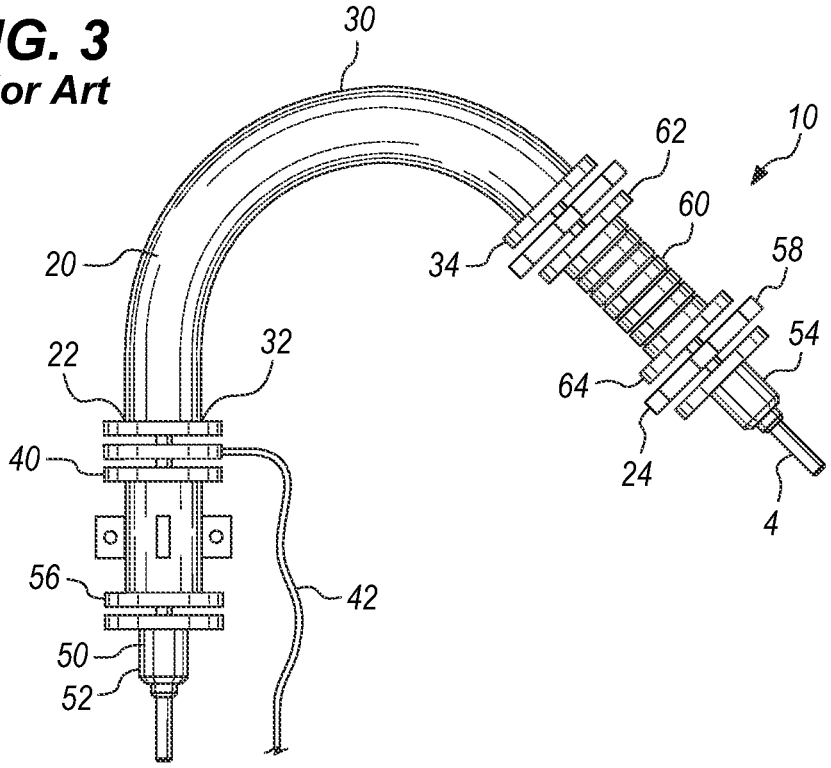
FIG. 4 a side elevation view of an embodiment of a bending apparatus for coiled tubing, according to the present invention.
Figure 5:
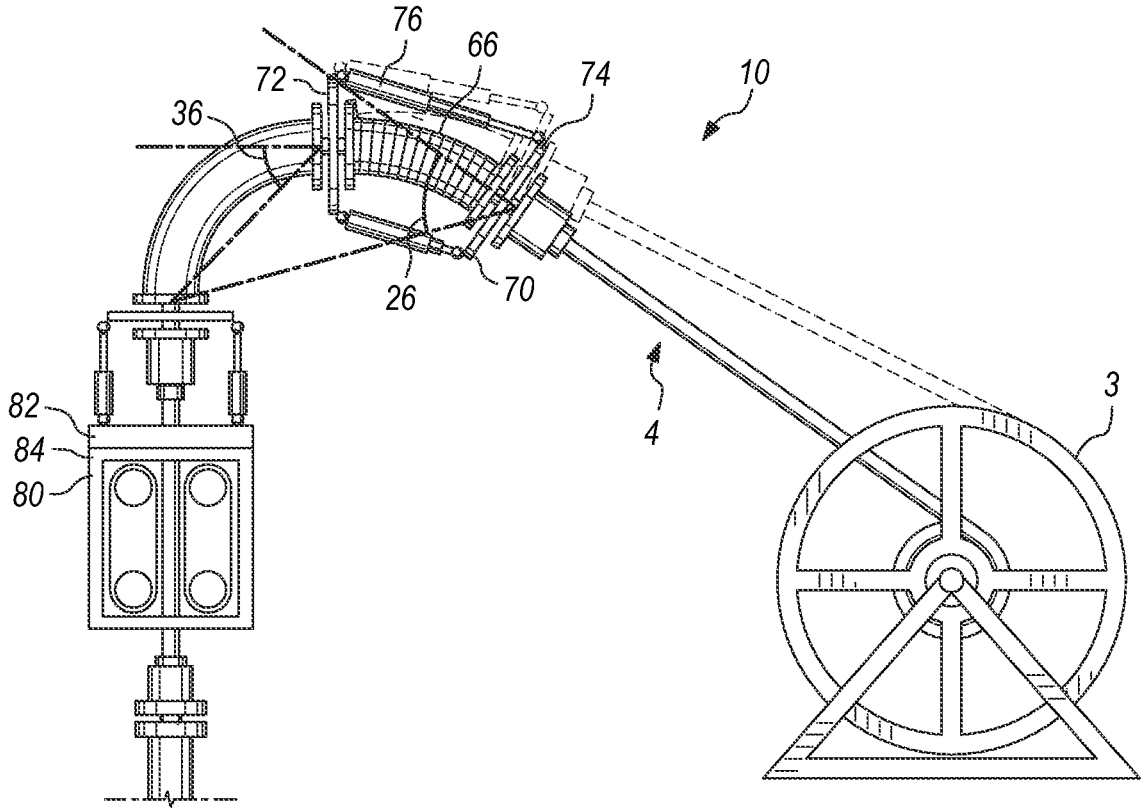
FIG. 5 is a side elevation view of the embodiment of FIG. 4 in a wellhead system for coiled tubing, according to the present invention.
Figure 6:
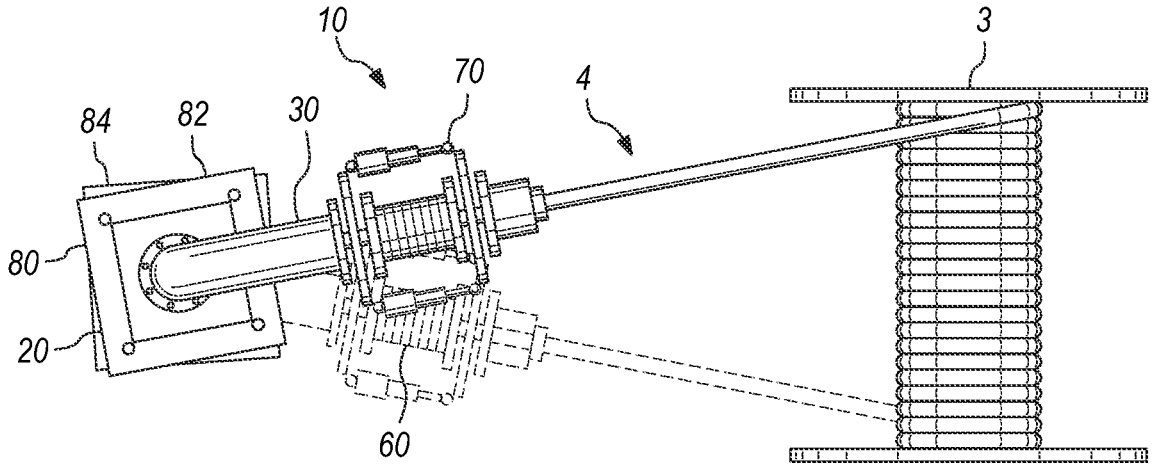
FIG. 6 is a top plan elevation view of the embodiment of FIG. 4 in the wellhead system for coiled tubing, according to the present invention.
Figure 7:
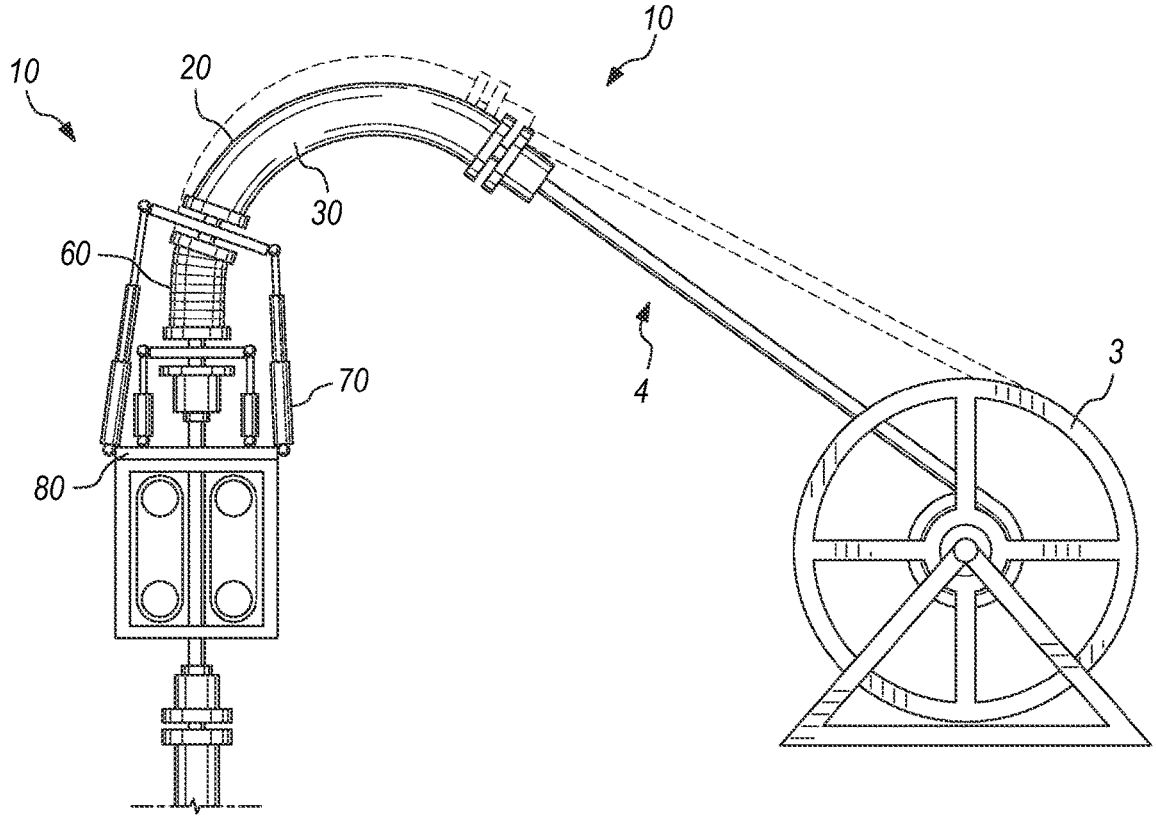
FIG. 7 is a side elevation view of another embodiment of a bending apparatus for coiled tubing, according to the present invention.
Figure 8:
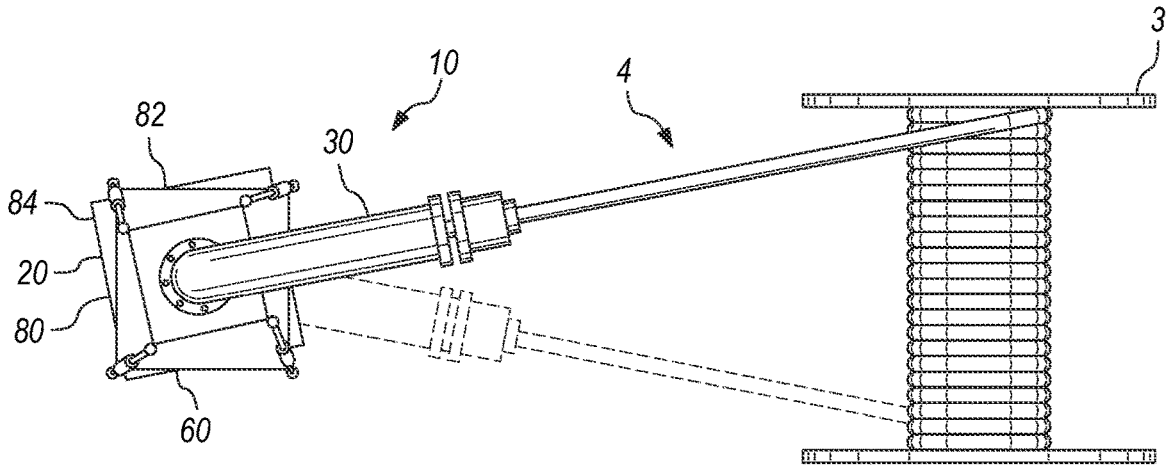
FIG. 8 is a top plan elevation view of the embodiment of FIG. 7 in the wellhead system for coiled tubing, according to the present invention.

FIGS. 4-6 show an embodiment of the bending apparatus 10 with the bend portion 30 between the flexible portion 60 and the proximal end 22. FIGS. 7-8 show an embodiment of the bending apparatus 10 with the flexible portion 60 between the bend portion 30 and the proximal end 22. There can also be embodiments with an additional flexible portion so that there is the flexible portion at the proximal end 22 and the additional flexible portion at the distal end 24. In FIG. 4, the bend portion can also be pressurized. The pressure equalization of the interior of the coiled tubing and the exterior of the coiled tubing, while the coiled tubing passes through the bend portion increases the working life of coiled tubing. The pressure control on both the interior and exterior of the coiled tubing reduces stress of the bend. FIG. 4 shows means 40 for pressurizing the bend portion 30 from the injector end 32 to the spool end 34. The means 40 for pressurizing includes a pressure hose 42 in fluid connection with the bend portion 30 at the injector end 32. The pressure hose 42 can regulate the pressure within the bend portion 30. The means 40 for pressurizing can include other components, such as pumps, seals, spools, including but not limited to kill spools, valves, O-rings, a bleed ring and bleed hose to control pressure, including releasing excess pressure from the bend portion 30. The means 40 for pressurizing can also include alternatives to a pressure hose, such as a spool, including but not limited to a kill spool, or flow tee valves or other fluid passageways.

The bend angle 36 avoids impingement between distal end 24 and proximal end 22. Analogous to the protection of prior art pressure necks and guides, the bend angle 36 of the bend portion 30 reduces bending stress and avoids kinks in the main controlled bend. The flexible bend angle 66 of the flexible portion 60 also avoids impingement between the distal end 24 and the proximal end 22. The flexible bend angle 66 can also reduce bending stress and avoid kinks in the bend portion with the bend angle 36 corresponding to the critical bend angle of the coiled tubing. The flexible bend angle 66 transitions the coiled tubing from the reel to the critical bend angle in the bend portion of the apparatus 10 of the present invention. The flexible portion 60 just being flexible does not re-introduce the risk of damage from sharp bends and kinks from the prior art. The flexible portion 60 protects the bend portion 30 from these sharp bends and kinks from the prior art. The flexible portion 60 of the present invention is defined by the flexible bend angle 66 such that the amount of flexibility of the flexible portion 60 is controlled and safe for coiled tubing. The more dynamic movement of the conduit 20 can be distributed between the bend portion 30 and the flexible portion 60 and to the flexible portion 60 so that the critical bend angle of the coiled tubing is protected.

Embodiments of the bending apparatus 10 show that the conduit bend angle 26 is comprised of the bend angle 36 and the flexible bend angle 66. In FIGS. 4-9, 12, 14, 16, 17, and 20, the flexible bend angle 66 is less than the bend angle 36. The bend angle 36 of the bend portion 30 is responsible for the critical bend angle of coiled tubing, which can be most of the bending from the reel or spool to the injector. The bend portion 30 can be controlled for the same protections against the sharpness of the bend, amount of force to bend, and the rate of bending in order to avoid damage and kinks in the coiled tubing. The flexible portion 60 accounts for finer adjustments due to upright angle and lateral angle of the coiled tubing from the reel or spool. FIGS. 4-9, 12, 14, 16, 17, and 20 separate the critical bend angle of the coiled tubing to the injector in the bend portion 30 and the minor bends in the flexible portion 60 related to the adjustments needed due to the mechanics of raveling and unraveling from the reel.

Figure 16:
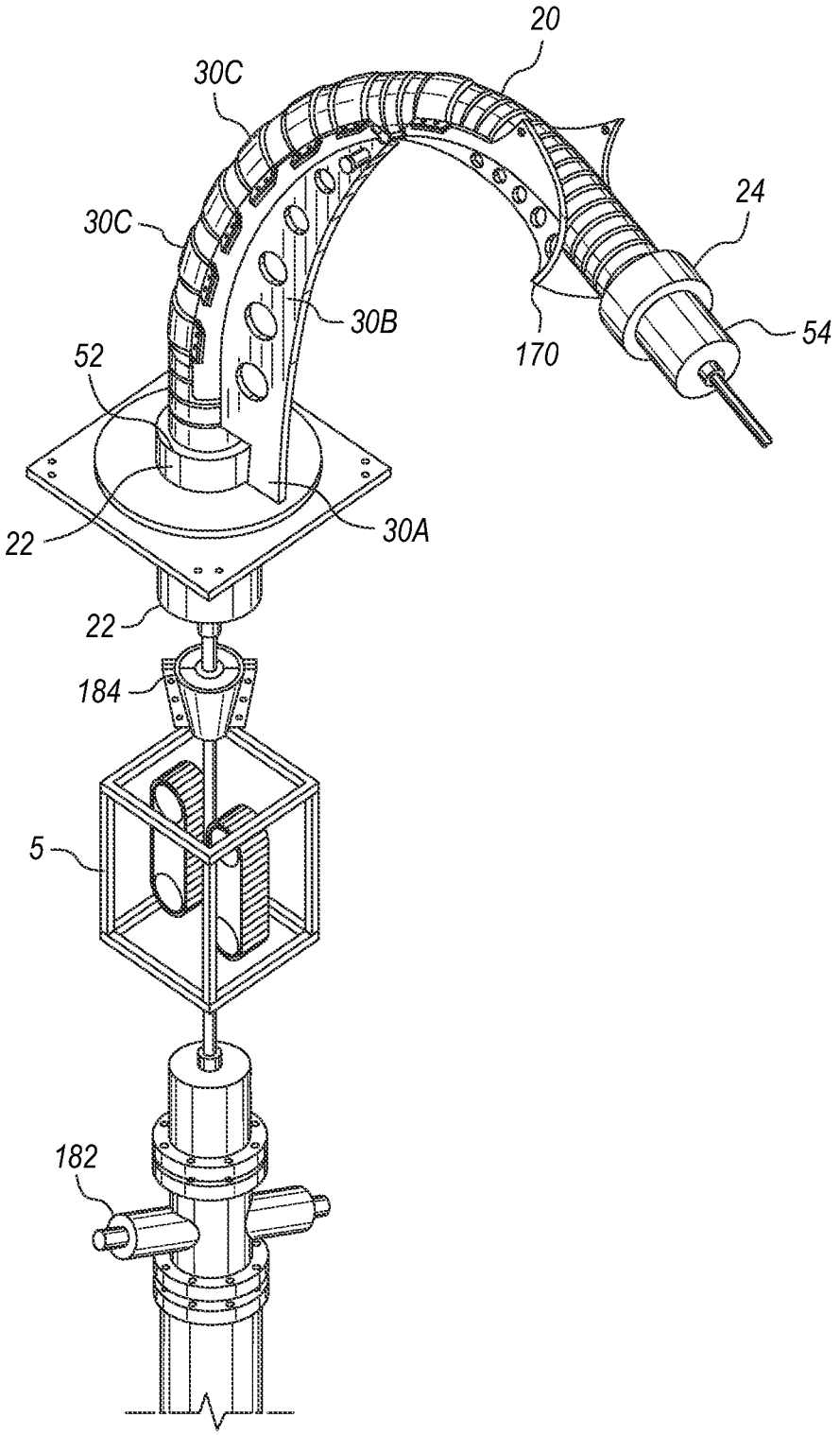
FIG. 16 is a perspective view of another embodiment of a bending apparatus for coiled tubing with unitary construction of the conduit, an exterior support system, and another support means, according to the present invention.

FIGS. 5-8, 14, 16, and 17 show an optional table mount 80 connected to the proximal end 22 of the conduit 20. FIG. 16 shows an embodiment without the optional table mount or any mechanical articulation at the proximal end 22. The table mount 80 is comprised of a table plate 82 connected to the proximal end 22, and a table base 84 in swiveling engagement to the table plate 82. The conduit 20 and the table plate 82 are rotatable together relative to the table base 84. The table base 84 can be fixed in position to the injector so that the conduit 20 can account for the change in lateral angles of the coiled tubing from the reel. The table base 84 is complementary to the conduit for adjusting to lateral angle changes of the coiled tubing from the reel.

FIGS. 5-8 also shown embodiments with a support means 70 for the flexible portion 60. The support means 70 can include a support bracket 72, 74 and a support arm system 76. FIGS. 5-8 show a first support bracket 74 at the first flexible end 64, a second support bracket 72 at the second flexible end 62, and support arm system 76. The support arm 76 can be a single support arm or a plurality of support arms. Each support arm 76 can be connected to the first support bracket 74 and the second support bracket 72. The support arms 76 hold position of the first flexible end 64 relative to the second flexible end 62. Other embodiments of a support means 70 may include a single support arm, multiple support arms, and different combinations of flanges, collars, and inflatable collars. The support brackets may also be flanges, collars or inflatable collars. Various winches, cables and pulleys can also be incorporated into a support means of the invention. Although flexible for adjustments due to variations in the upright angle and the lateral angle from the reel, the flexible portion 60 can be stabilized to allow for the coiled tubing to pass through any of the variations in the uprights angle or lateral angle or both. A table mount is no longer required as the distal end has the range to account for the lateral angle changes of the coiled tubing from the reel.

FIGS. 9-13 show the embodiment of the bending apparatus 10 with an impingement sleeve 38. In these embodiments, the impingement sleeve 38 is comprised of a first sleeve portion 37 and a second sleeve portion 39. The first sleeve portion 37 is positioned within the bend portion 30, and the second sleeve portion 39 is positioned within the flexible portion 60. The second sleeve portion 39 is detachable from the first sleeve portion 37. The first sleeve portion 37 and the second sleeve portion 39 can be made integral as a continuous impingement sleeve 38 as in FIGS. 12-13. The second sleeve portion 39 is a removable extension of the first sleeve portion 37. The first sleeve portion 37 and the second sleeve portion 39 can be separate parts of the impingement sleeve 38 as in FIGS. 9-11. The second sleeve portion 39 has inconsistent wear because the flexible portion 60 adjusts with more variability than the bend portion 30. The repetitive movements degrade only a portion of the impingement sleeve 30. The present invention allows removal and replacement without affecting the first sleeve portion 37 in the bend portion 30.

Figure 9:
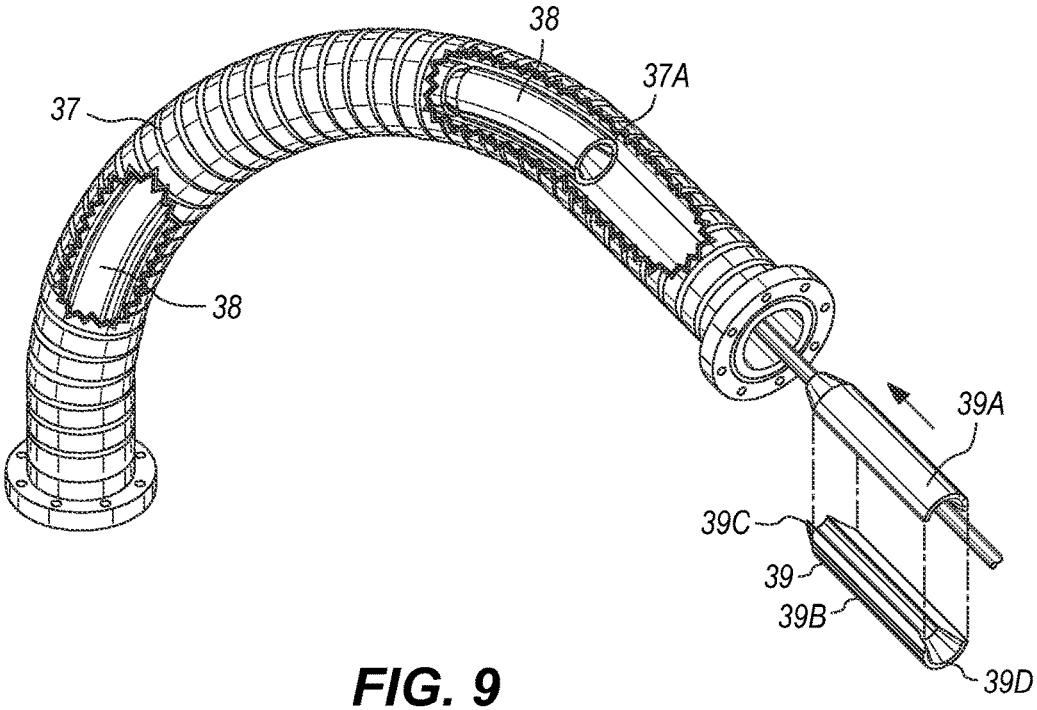
FIG. 9 is a partially exploded perspective view of an embodiment of the conduit with a bend portion and flexible portion with the impingement sleeve, according to the present invention.
Figure 10:
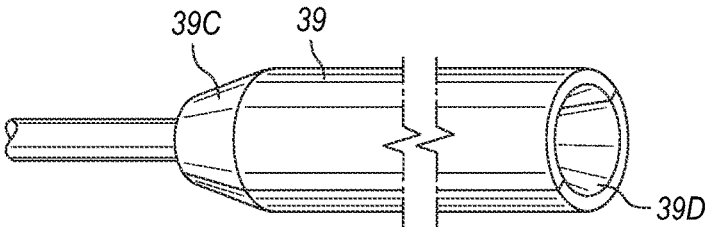
FIG. 10 is an isolated enlarged perspective view of an embodiment of a replaceable portion of the impingement sleeve of FIG. 9.
Figure 11:
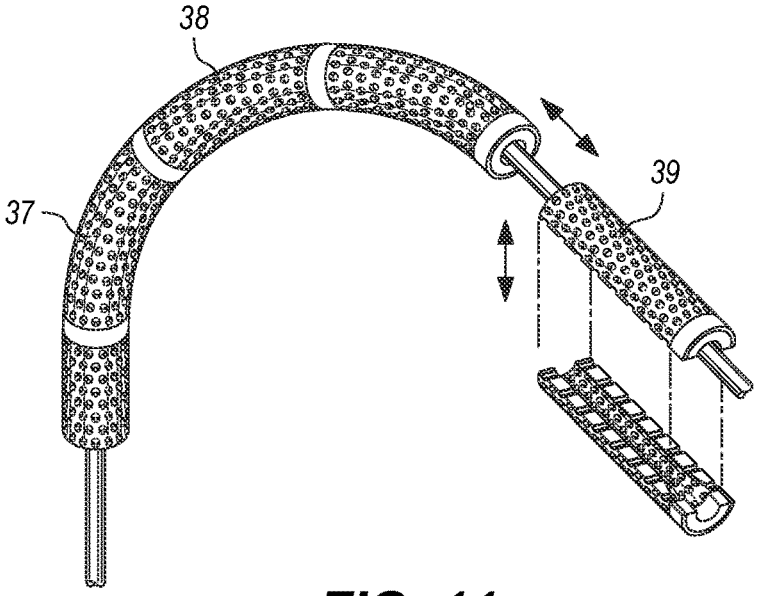
FIG. 11 is a perspective view of another embodiment of FIG. 9, showing a perforated impingement sleeve around the coiled tubing.
Figure 12:
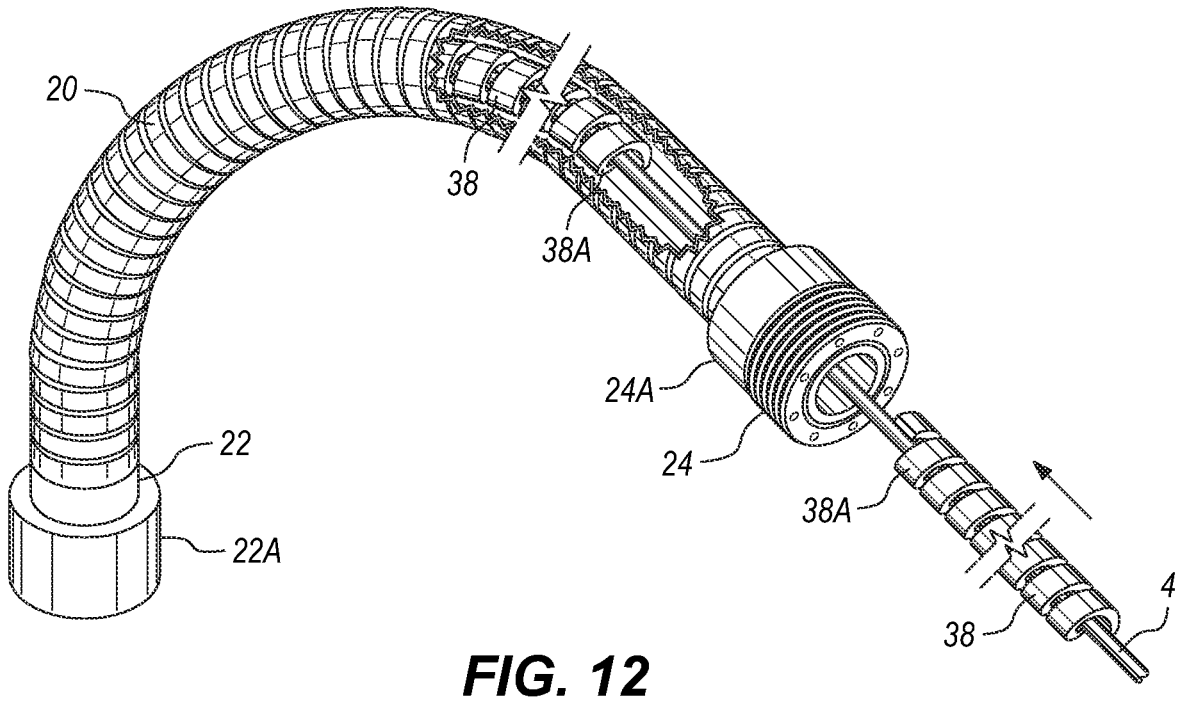
FIG. 12 is a perspective view of still another embodiment of FIG. 9, showing an impingement sleeve in another embodiment of the conduit and with coiled tubing as a wrapped strip.
Figure 13:
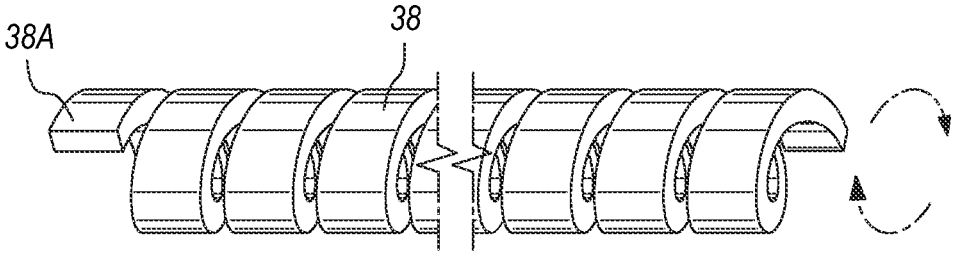
FIG. 13 is an isolated enlarged perspective view of the impingement sleeve of FIG. 12.

FIGS. 9-10 show a particular embodiment with detachable male-female engagement between the first sleeve portion 37 and the second sleeve portion 39. In FIG. 9, the second sleeve portion 39 is comprised of a male connector end 39C and the first sleeve portion 37 is comprised of a first female connector end 37A cooperative with the male connector end 39C. The male connector end 39C can be conical, and the first female connector end 37A can be inverse conical. The male connector end 39C and first female connector end 37A can be other cooperative shapes, such as spherical and inverse spherical. The first sleeve portion 37 and the second sleeve portion 39 can be modular so that the worn parts of the second sleeve portion 39 can be easily replaced with another compatible male connector end. In some embodiments, the second sleeve portion 39 is comprised of a second female connector end 39D opposite the male connector end 39C. There can be more than one second sleeve portion 39 so that different parts of the impingement sleeve 38 in the flexible portion 60 can be separately replaced with another modular part. FIG. 11 shows an embodiment of the impingement sleeve 38 with an abutment engagement between the first sleeve portion 37 and the second sleeve portion 39. FIGS. 12-13 show an embodiment of the impingement sleeve 38 with a tearing engagement between the first sleeve portion 37 and the second sleeve portion 39.

The present invention includes other variations of the partially replaceable second sleeve portion 39. FIGS. 9 and 11 show the second sleeve portion 39 being comprised of a first half 39A and a second half 39B removably attached to the first half. FIG. 11 also shows the impingement sleeve 38 as perforated. The three dimensional holes forming the perforated impingement sleeve 38 can be important for transmission of fluid lubricants from inside the pressure neck to the surface of the coiled tubing. FIGS. 12-13 also show an embodiment of the impingement sleeve 38 being comprised of a wrapped strip 38A. The thickness of the wrapped strip 38A is compatible with the coiled tubing for protection within the conduit 20 of the bending apparatus 10. The second sleeve portion 39 remains partially replaceable for maintaining protection of the coiled tubing in the flexible portion 60.

Figures 14, 15:
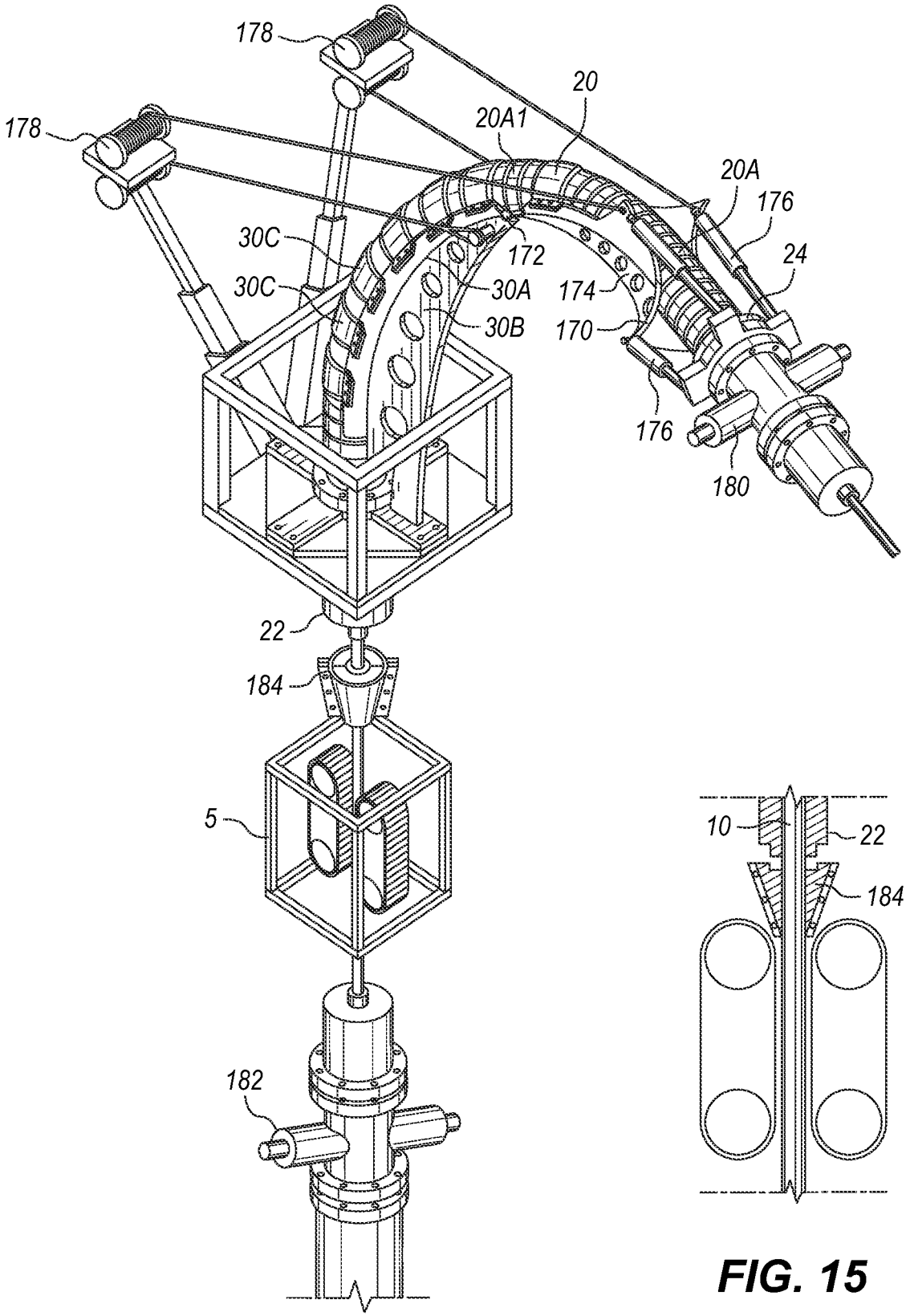
FIG. 14 is a perspective view of another embodiment of a bending apparatus for coiled tubing with unitary construction of the conduit, an exterior support system, another support means, and safety components, according to the present invention.
FIG. 15 is a schematic view of a junction between embodiments of the bending apparatus of the present invention with a safety component relative to an injector.

Embodiments of the bending apparatus 10 are also compatible with safety components. FIG. 14 shows an embodiment with a distal blow-out preventer 180 at the distal end 24. In an emergency, a blow-out preventer (BOP) has blind shear rams that can cut the coiled tubing, when triggered. The distal BOP 180 enables the present invention to cut the coiled tubing and retain the cut coiled tubing within the bending apparatus 10. The coiled tubing no longer risks falling back into the wellhead, when an emergency triggers the distal BOP 180. The coiled tubing is retained within the bending apparatus 10 as pressurized and with any fluids therein. With coiled tubing pressure and a fluid connection (such as the pressure hose 42 of the means for pressurizing 40) in the conduit 20, the well can be killed by circulating fluid down the cut coiled tubing. There is also a proximal blow-out preventer 182 at the proximal end 22 as in the prior art. The proximal BOP 182 remains as a conventional location that can cut the coiled tubing in emergencies. The proximal BOP 182 allows the coiled tubing to still be intentionally cut, while intentionally falling back into the wellhead. There may be some emergency circumstances in which coiled tubing should not be left holding in the pressure neck as the bending apparatus 10. The present invention can account for both types of emergencies for the versatility to sometimes preserve the coiled tubing out of the wellhead. The efficiency and recovery can be much faster for these types of emergencies with the present invention. The present invention is compatible with both safety components in both locations relative to the conduit 20.

FIGS. 14-16 show another embodiment of the bending apparatus 10 compatible with another safety component. There is a buckle protector 184 at the proximal end 22. The transition from bending apparatus 10 to the injector is protected. Once bent properly at the critical bend angle, the present invention is compatible with further protecting the coiled tubing as the coiled tubing exits the conduit 20. The buckle protector 184 is another known redundancy that can be incorporated into the present invention. The present invention reduces coil tubing buckling forces in the space between the bending apparatus and the tracks or gripping blocks of an injector. It is also noted that the distal blow-out preventer (BOP) 180 at the distal end 24, the proximal blow-out preventer (BOP) 182 at the proximal end 22, and the buckle protector 184 can be incorporated into the embodiments of the bending apparatus in FIGS. 5-8, 14, 16, 17 and 20. These safety devices can be compatible with these other earlier embodiments of the pressure neck as the bending apparatus 10.

Embodiments of the present invention also include the distal end 24 being comprised of a distal connector 24A and the proximal end 22 being comprised of a proximal connector 22A. The connectors 22A, 24A can be flanged as in FIGS. 9, 14, 17, and 20 or threaded as in FIGS. 12 and 16 or otherwise unionized conduit connections. The connectors 22A, 24A allow attachment of other components, such as a distal stripper 54, a proximal stripper 52, distal BOP 180, BOP kill spools, flow tee valves, other means for pressurizing 40, or other brackets and cams for the treatment of the coiled tubing or support for bending apparatus 10 as a pressure neck itself. FIG. 16 also shows a round (turret) style table plate at the proximal end 22. The round (turret) style table plate can assist with initial loading of the coiled tubing and major alignments with the reel during setup.

Figure 20:
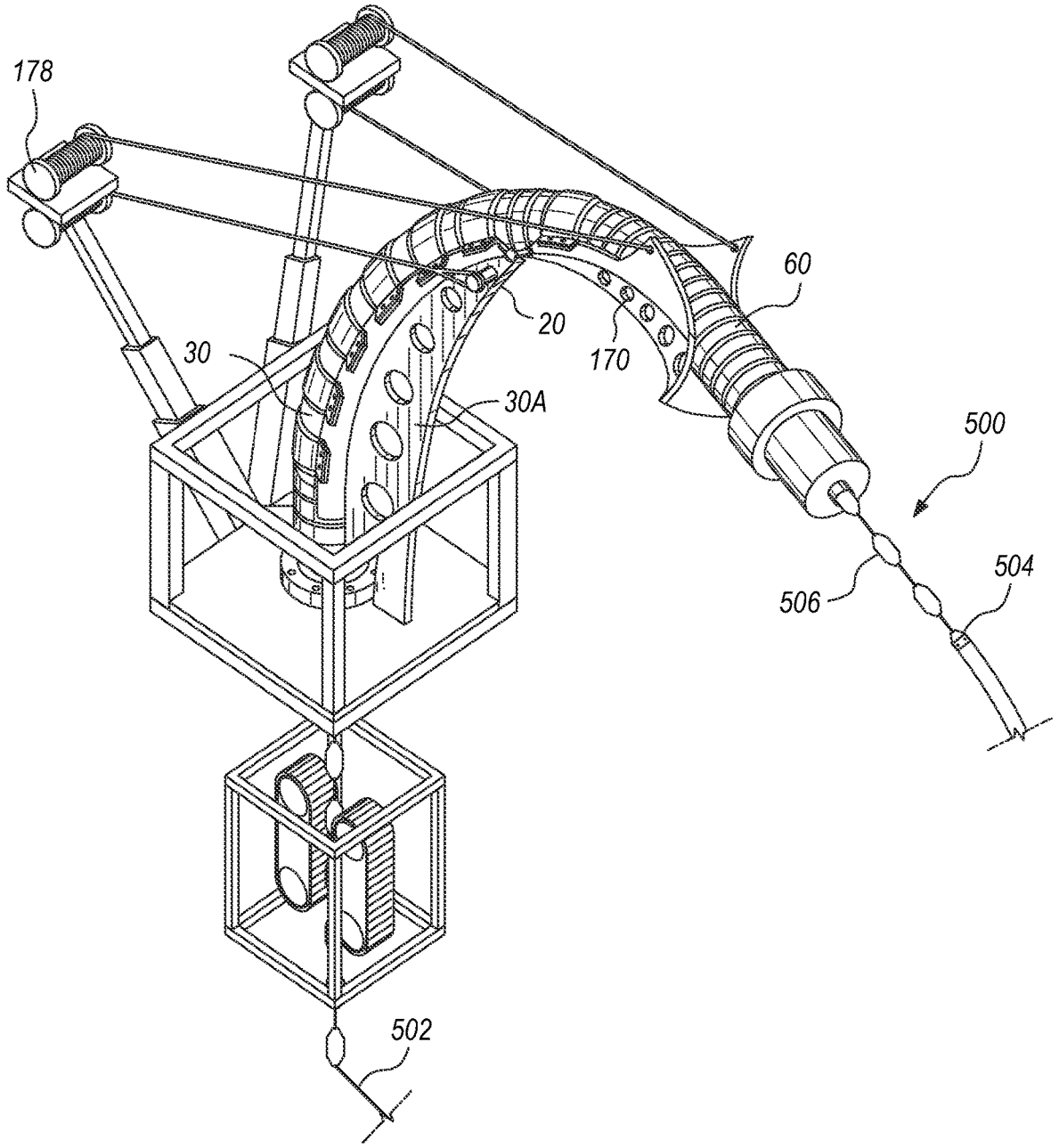
FIG. 20 a perspective view of another embodiment of another bending apparatus for coiled tubing with a threader for loading the coiled tubing into the wellhead system, according to the present invention.

FIGS. 14, 16, and 20 show another embodiment of the bending apparatus 10 for a conduit 20, including both the bend portion 30 and the flexible portion 60, being comprised of a flexible tubular member 20A. The unitary construction of the conduit 20 address manufacturing, assembly, and cost efficiency concerns. The present invention further adapts the bending apparatus 10 to remain functional and protective by the bend portion 30 being further comprised of an exterior support system 30A attached to a portion 20A1 of the flexible tubular member corresponding to the bend portion 30. The exterior support system 30A provides the stability and strength to maintain the bend angle 36, despite the flexibility of the flexible tubular member 20A. The exterior support system 30A is a type of support for the bending apparatus 10 with unitary construction of the bend portion 30 and flexible portion 60 of the conduit 20.

The embodiment of the exterior support system 30A in FIG. 14 is comprised of an exoskeleton 30D having an inner curved spine 30B and a plurality of outer ribs 30C attached to the inner curved spine 30B. The flexible tubular member 20A can be visible through the outer ribs 30C as long as the bend angle 36 is maintained. Various distributions and numbers of outer ribs 30C can be used to form the exoskeleton 30D. The exoskeleton 30D may also require additional support for reliable and resilient positioning of the pressure neck 10. said exterior support 30A is comprised of support means 70. An alternate embodiment of the exterior support system 30A is shown in FIGS. 5-7. The support means 70 can be comprised of a support bracket (first support bracket 72, second support bracket 74) and a support arm system 76. The support arm system 76 includes at least one support arm 76 being attached to the support bracket 72, 74. The support arm system 76 can include hydraulic arms and the known supports, mounts, and controls for setting position of the support means 70.

FIGS. 14, 16 and 20 show an embodiment of the present invention with another support means 170 of the flexible portion 60, when the bend portion 30 is comprised of the exterior support system 30A. Another support means 170 of the flexible portion 60 can be comprised of a universal joint (or hinge pivot) 172 connected to the exterior support system 30A, a joint frame (or hinge plate for the hinge pivot) 174 connected to the universal joint (or hinge pivot) 172, and a support arm system 176 connected to the joint frame 174. The universal joint 172 allows a full range of movement, unlike a hinge with movement in only one direction. The universal joint 172 allows the swiveling of the flexible portion 60 of the conduit 20 for the coiled tubing. The alternate embodiment is a hinge pivot 172 for simpler one direction movement and the corresponding hinge plate 174. The joint frame or hinge plate 174 and support arm system 176 connected to the joint frame 174 are additional supporting components to position the flexible portion 60 and hold the flexible portion 60 resiliently in place, while the coiled tubing passes through the bending apparatus 10. The support arm system 176 can include other support arms, winches, hydraulic arms, and cables stays as supporting components to further stabilize and hold the position of the flexible portion 60 of the conduit 20. The another support means 170 of the flexible portion 60 can further include a pulley arm system 178 connected to the joint frame 174, as in FIG. 14 present invention also comprises other supporting components, such as a pulley arm system 178 connected to the joint plate 174 as in FIGS. 14 and 20. The pulley arm system 178 can include other pulley arms (arms with winches), additional winches alone, hydraulic arms, and cables stays as supporting components to further stabilize and hold the position of the flexible portion 60 of the conduit 20. Similar to the support means 70 of FIGS. 5-8, the supporting components may include a single support arm, multiple support arms, brackets, and different combinations of flanges, collars, and inflatable collars.

Figure 17:
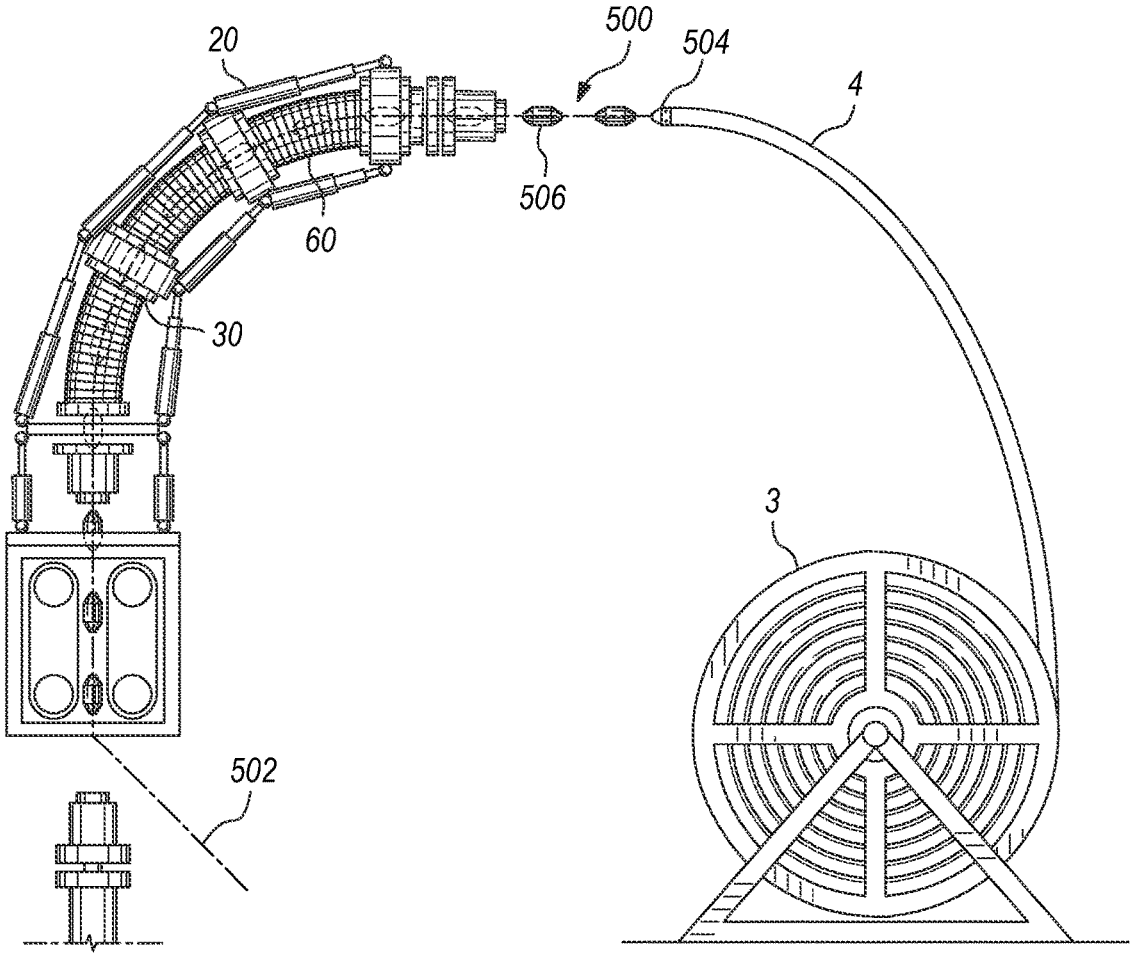
FIG. 17 a side elevation view of another embodiment of a bending apparatus for coiled tubing with a threader for loading the coiled tubing into the wellhead system, according to the present invention.

FIGS. 17-20 further show the embodiment of the present invention as a bending and loading apparatus including a threader 500 having a lead end 502 and a tubing connector end 504 opposite the lead end 52. The lead end 502 removably engages the conduit 20 through the distal end 24 to the proximal end 22 so as to load the coiled tubing 3 into the conduit 20. FIGS. 17-20 show the threader 500 comprising a flexible cable 504; a plurality of gripper beads 506 mounted along the flexible cable 505; and a tubing connector 508 attached to the flexible cable 505 at the tubing connector end 504 so as to removably attach to the coiled tubing 3. The removable attachment can be mechanical, like threaded, bolted, or snap-fit engagement. The threader 500 is a temporary component that is only used to load the coiled tubing 3. FIGS. 17 and 20 both show the lead end 502 being directed from the injector 5 of the wellhead system. Once aligned by the bending apparatus 10, the coiled tubing 3 is passed to the injector 5 for deployment into the wellhead system, after the threader 500 is removed.

Figure 18:
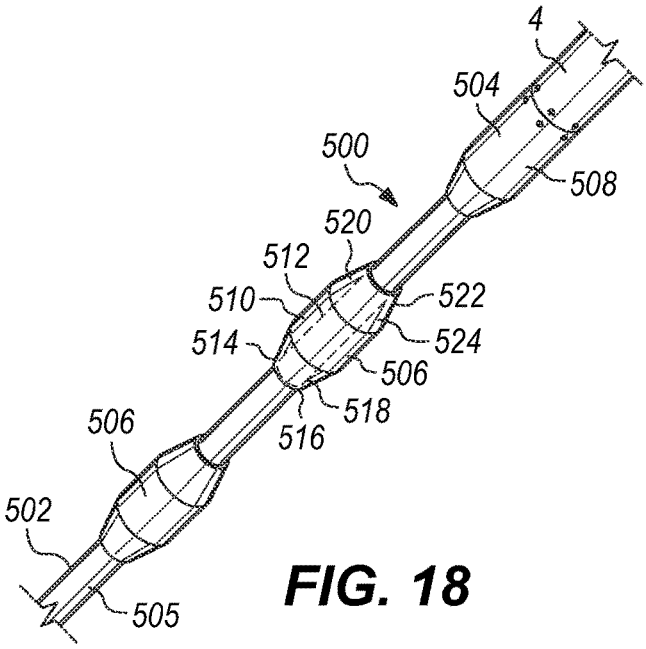
FIG. 18 is an enlarged perspective view of the embodiment of the threader connected to the coiled tubing, according to the present invention.
Figure 19:
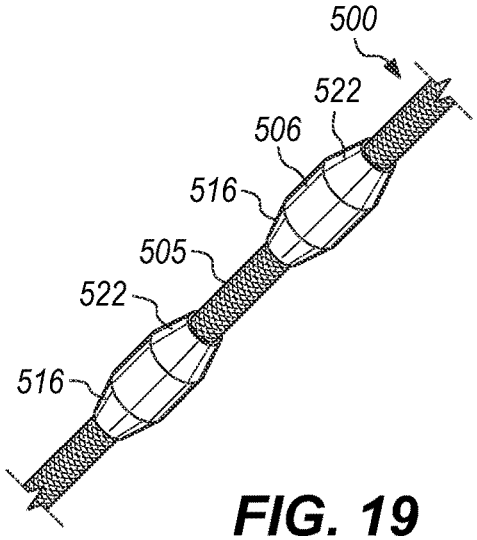
FIG. 19 is another enlarged perspective view of another embodiment of the threader.

FIGS. 18-19 show that each gripper bead 506 comprises: a bead body 510 having a bead body channel 512; a proximal bead end 514 having a proximal outer tapered surface 516 and a proximal internal channel 518; and a distal bead end 520 having a distal internal channel 524. In some embodiments, the distal bead end 520 can also have a distal outer tapered surface 522. The proximal bead end 514 and the distal bead end 520 are connected to the bead body 510. The bead body 510 is between the proximal bead end 514 and the distal bead end 520 with the distal bead end 520 facing toward the tubing connector end 504. The flexible cable 505 extends through the distal internal channel 524, the bead body channel 512, and the proximal internal channel 518. The flexible cable 505 can be wire cable, a rod, braided wire, or any solid tubular member with suitable strength and flexibility to be pulled through the bending and loading apparatus 10 of the present invention. The gripper bead 506 is fixedly attached to the flexible cable 505. In some embodiments, the proximal outer tapered surface 516 is conical, the proximal outer tapered surface 516 narrowing from the bead body 510. The distal outer tapered surface 522 is similarly conical, except that the distal outer tapered surface 522 widens to the bead body 510.

The present invention provides a bending apparatus for inserting coiled tubing from a reel or spool and into a well through a wellhead. The present invention protects the coiled tubing during the critical bend angle and protects from additional risks for damage separate from the critical bend angle. The bending apparatus protects the coiled tubing between the reel and the bending apparatus and between the bending apparatus and the injector of the wellhead. Between the reel and the bending apparatus, the upright angle of dispensing from the reel changes as coiled tubing is unraveled and raveled. The lateral angle of dispensing from a reel oscillates back and forth across the reel as coiled tubing is unraveled and raveled. The bending apparatus of the present invention includes a flexible portion to account for these changing angles, which prevents damage, such as tears, strains, and kinks. In the present invention, the amount of swiveling can be reduced relative to the prior art. The present invention can fit more locations and require less movement.

The bend portion of the present invention is clearly distinguished from the flexible portion so that the bend angle of the bend portion corresponds to the critical bend angle of the coiled tubing. The bending of the coiled tubing through the present invention is not treated the same in all portions. The flexible bend angle makes smaller and dynamic adjustments to protect the bend angle of the bend portion. The flexible portion reduces the impact of these more dynamic adjustments required from the dispensing of the coiled tubing from large reels. The bending apparatus itself is not pulled and yanked as in the prior art. Only the flexible portion is pulled and yanked so that the flexible bend angle transitions the coiled tubing to the bend angle with more stability and support. The flexible portion can have less bend than the bend portion. The flexible portion is fine tuning of the alignment of the coiled tubing so that there are no tears, strains or kinks as the coiled tubing enters or exits the conduit. The flexible portion can adjust, but the flexible portion must also be sufficiently stable to remain aligned with the conduit. There is less risk of damage to the coiled tubing by the transition from the reel to the injector when the flexible portion transitions coiled tubing to the bend angle of the bend portion for the critical bend angle of the coiled tubing.

The flexible portion changes position more frequently than the bend portion. The supporting structures of the flexible portion experience more wear, since the change and adjustments to different positions is more common. The present invention can include an impingement sleeve to be adjustable and replaceable. There are differences in wear and tear on the different portions of the impingement sleeve corresponding to the bend portion and the flexible portion of the conduit. The different forces on the bend portion and the flexible portion also affect the impingement sleeve. The sleeve portion of the impingement sleeve in the flexible portion can be detached from the sleeve portion of the impingement sleeve in the bend portion. With modular and multiple sleeve portions in the flexible portion, the uneven wear on the impingement sleeve is avoided so that the coiled tubing remains protected. also includes an impingement sleeve to further support and protect the coiled tubing within the bending apparatus or pressure neck.

Safety components can be incorporated into the bending apparatus of the present invention. Blow-out preventers and buckle protectors are compatible with the bending apparatus of the present invention for further support and protection of the coiled tubing. There is also the particular advantage of the coiled tubing being retained within the bending apparatus as pressurized and with any fluids therein. With coiled tubing pressure in the conduit, the well can be killed by circulating fluid down the cut coiled tubing. The recovery from an emergency can be much faster. The ends of the conduit are also compatible with various attachments for support and protection of the coiled tubing.

The present invention also addresses a pressure neck or bending apparatus with a conduit of unitary construction. The bend portion and flexible portion must be supported different from each other, even when the conduit is constructed of a single material. When manufacturing, assembly, and cost considerations modified the bending apparatus to have a conduit of one construction, there must still be a bend portion and a flexible portion defined by the invention. An exterior support system is attached to the conduit to form the bend portion. The exterior support system can be an exoskeleton or other exterior support system on the bend portion. There can also be another support system for the flexible portion. The present invention reinforces the differential support of the bend portion with the bend angle different and the flexible portion with the flexible bend angle exposed to the more frequent, but smaller adjustments. The support components, such as support arm systems, pulley arm systems, universal joints, hinge pivots, joint frames, hinge plates, winches and cable stays are modifications to enable a more efficient and easier to install and construct the bending apparatus.

The present invention further discloses incorporating safety components in particular positions relative to the conduit, impingement sleeve, and exoskeleton in the embodiments of the present invention. The coiled tubing can be cut, during emergencies, while retaining the coiled tubing within the pressure neck, while still addresses other emergencies that must be resolved without the coiled tubing remaining in the bending apparatus.

The threader of the present invention increases safety while loading the coiled tubing through the conduit and table mount. The initial threading of the coiled tubing from the reel and into the conduit now avoids the risk of damage to the coiled tubing. The threader is removable so that only the coiled tubing is actually deployed into the well.

The foregoing disclosure and description of the invention is illustrative and explanatory thereof. Various changes in the details of the illustrated structures, construction and method can be made without departing from the true spirit of the invention.

I claim:

1. A bending apparatus for coiled tubing, the apparatus comprising:

a conduit having a proximal end and a distal end opposite said proximal end, wherein said proximal end is positioned relative to said distal end so as to determine a conduit bend angle of said conduit, wherein said conduit is comprised of:

a bend portion having an injector end toward said proximal end and a spool end toward said distal end opposite said spool end, wherein said injector end is positioned relative to said spool end so as to determine a bend angle of said bend portion;

a flexible portion having a first flexible end toward said proximal end and a second flexible end toward said distal end and opposite said exit end, wherein said first flexible end is positioned relative to said second flexible end so as to determine a flexible bend angle of said flexible portion, wherein said conduit bend angle is comprised of said bend angle and said flexible bend angle, and wherein said flexible bend angle is less than said bend angle between said first flexible end and said second flexible end so as to protect coiled tubing from damage when bending in said bend portion at said bend angle; and an impingement sleeve being comprised of a first sleeve portion and a second sleeve portion, said first sleeve portion being positioned within said bend portion, said second sleeve portion being positioned within said flexible portion, said second sleeve portion being detachable from said first sleeve portion.

2. The bending apparatus, according to claim 1, wherein said first sleeve portion and said second sleeve portion are in detachable male-female engagement.

3. The bending apparatus, according to claim 1, wherein said second sleeve portion is comprised of a first half, and a second half removably attached to said first half.

4. The bending apparatus, according to claim 1, said impingement sleeve is perforated.

5. The bending apparatus, according to claim 1, said impingement sleeve is comprised of a wrapped strip.

6. A bending apparatus for coiled tubing, the apparatus comprising:

a conduit having a proximal end and a distal end opposite said proximal end, wherein said proximal end is positioned relative to said distal end so as to determine a conduit bend angle of said conduit, wherein said conduit is comprised of:

a bend portion having an injector end toward said proximal end and a spool end toward said distal end opposite said spool end, wherein said injector end is positioned relative to said spool end so as to determine a bend angle of said bend portion; and a flexible portion having a first flexible end toward said proximal end and a second flexible end toward said distal end and opposite said exit end, wherein said first flexible end is positioned relative to said second flexible end so as to determine a flexible bend angle of said flexible portion, wherein said conduit bend angle is comprised of said bend angle and said flexible bend angle, wherein said flexible bend angle is less than said bend angle, wherein said bend portion and said flexible portion of said conduit are comprised of a flexible tubular member, and wherein said bend portion is further comprised of an exterior support system attached to a portion of said flexible tubular member corresponding to said bend portion.

7. The bending apparatus, according to claim 6, further comprising:

a distal blow-out preventer at said distal end.

8. The bending apparatus, according to claim 6, further comprising:

a buckle protector at said proximal end.

9. The bending apparatus, according to claim 6, wherein said distal end is comprised of a distal connector so as to attach a distal stripper, and wherein said proximal end is comprised of a proximal connector so as to attach a proximal stripper.

10. The bending apparatus, according to claim 6, wherein said exterior support system is comprised of an exoskeleton, said exoskeleton being comprised of an inner curved spine and an outer rib system attached to said inner curved spine.

11. The bending apparatus, according to claim 6, further comprising:

a support means for said flexible portion being comprised of a universal joint connected to said exterior support system, a joint frame connected to said universal joint, and a support arm system connected to said joint frame.

12. The bending apparatus, according to claim 11, wherein the support means further comprises a pulley arm system connected to said joint frame.

13. The bending apparatus, according to claim 6, further comprising:

another support means for said flexible portion being comprised of a hinge pivot connected to said exterior support system, a hinge plate connected to said hinge joint, and a support arm system connected to said hinge plate.

14. The bending apparatus, according to claim 13, wherein the another support means further comprises a pulley arm system connected to said hinge plate.

15. The bending apparatus, according to claim 6, wherein said exterior support system is comprised of support means, wherein said support means is comprised of a support bracket and a support arm system, at least one support arm of said support arm system being attached to said support bracket.

16. A bending and loading apparatus for coiled tubing, the apparatus comprising:

a conduit having a proximal end and a distal end opposite said proximal end, wherein said proximal end is positioned relative to said distal end so as to determine a conduit bend angle of said conduit, wherein said conduit is comprised of:

a bend portion having an injector end toward said proximal end and a spool end toward said distal end opposite said spool end, wherein said injector end is positioned relative to said spool end so as to determine a bend angle of said bend portion; and a flexible portion having a first flexible end toward said proximal end and a second flexible end toward said distal end and opposite said exit end, wherein said first flexible end is positioned relative to said second flexible end so as to determine a flexible bend angle of said flexible portion, wherein said conduit bend angle is comprised of said bend angle and said flexible bend angle, wherein said flexible bend angle is less than said bend angle; and a threader having a lead end and a tubing connector end opposite said lead end so as to be removably connected to coiled tubing at said tubing connector end, wherein said lead end removably engages said conduit through said distal end to said proximal end so as to load the coiled tubing into said conduit.

17. The bending and loading apparatus, according to claim 16, wherein said threader comprises:

a flexible cable;

a plurality of gripper beads mounted along said flexible cable; and a tubing connector attached to said flexible cable at said tubing connector end so as to removably attach to the coiled tubing.

18. The bending apparatus, according to claim 16, wherein each gripper bead comprises:

a bead body having a bead body channel, said flexible cable being within said bead body channel;

a proximal bead end having a proximal outer tapered surface and a proximal internal channel and being connected to said bead body, said flexible cable being within said proximal internal channel; and a distal bead end having a distal internal channel and being connected to said bead body, said flexible cable being within said distal internal channel, wherein said bead body is between said proximal bead end and said distal bead end, said distal bead end facing toward said tubing connector end.

19. The bending apparatus, according to claim 18, wherein said distal bead end has a distal outer tapered surface, wherein proximal outer tapered surface is conical, said proximal outer tapered surface narrowing from said bead body, and wherein said distal outer tapered surface is conical, said distal outer tapered surface widening to said bead body.

* * * * *